US005690414A

United States Patent [19]

Jeng

[11] Patent Number: 5,690,414

[45] Date of Patent: Nov. 25, 1997

[54] SCREW DRIVER ADAPTED FOR USE AS A SIGNALING DEVICE

[76] Inventor: Jong-Pyng Jeng, No. 9-1, Ting-Nan, Ying-Chuan Li, Huwei Chen, Yunlin Hsien, Taiwan

[21] Appl. No.: 781,937

[22] Filed: Dec. 3, 1996

[51] Int. Cl.[6] ..... B25B 23/18

[52] U.S. Cl. ..... 362/120; 362/119; 362/186; 362/208; 362/184

[58] Field of Search ..... 362/119, 120, 362/186, 208, 184, 185, 234

[56] References Cited

U.S. PATENT DOCUMENTS

| | | | |
|---|---|---|---|
| 4,283,757 | 8/1981 | Nalbandian et al. | 362/120 |
| 4,480,295 | 10/1984 | Shuster | 362/119 X |
| 5,577,829 | 11/1996 | Hall | 362/119 |

*Primary Examiner*—Stephen F. Husar
*Attorney, Agent, or Firm*—Marshall & Melhorn

[57] ABSTRACT

A screw driver includes a handle body, a shank and a light transmittable tubular member. The handle body has a front end portion with an end surface, and an illuminating unit mounted on the front end portion at the end surface. The handle body confines a compartment for receiving a cell unit therein. The handle body is provided with a switch unit that is adapted to connect electrically the cell unit to the illuminating unit. The shank is mounted on the handle body and extends from the end surface of the front end portion of the handle body. The tubular member has a rear end mounted detachably on the front end portion of the handle body around the end surface of the front end portion. The tubular member is capable of transmitting light generated from the illuminating unit to an exterior of the tubular member so as to achieve a signaling effect.

6 Claims, 6 Drawing Sheets

SCREW DRIVER ADAPTED FOR USE AS A SIGNALING DEVICE

BACKGROUND OF THE INVENTION

1. Field of the Invention

The present invention relates to a screw driver, more particularly to a screw driver that is provided with an illuminating unit and that is adapted for use as a signaling device, such as a signaling stick.

2. Description of the Related Art

When a car breaks down due to engine trouble or the like, a screw driver with an illuminating unit is very helpful in repairing the car, especially at night. In this situation, a signaling device, such as a signaling stick, might be necessary for warning other cars passing along the road. A conventional screw driver with an illuminating unit fixed thereon cannot serve as a signaling device since the light offered by the illuminating unit only covers a limited range.

SUMMARY OF THE INVENTION

The main object of the present invention is to provide a screw driver which is adapted for use as a signaling device.

Accordingly, the screw driver of the present invention includes a handle body, a shank and a light transmittable tubular member. The handle body has a front end portion with an end surface, and an illuminating unit mounted on the front end portion at the end surface. The handle body confines a compartment for receiving a cell unit therein. The handle body is provided with a switch unit that is adapted to connect electrically the cell unit to the illuminating unit. The shank is mounted on the handle body and extends from the end surface of the front end portion of the handle body. The tubular member has a rear end mounted detachably on the front end portion of the handle body around the end surface of the front end portion. The tubular member is capable of transmitting light generated from the illuminating unit to an exterior of the tubular member so as to achieve a signaling effect.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
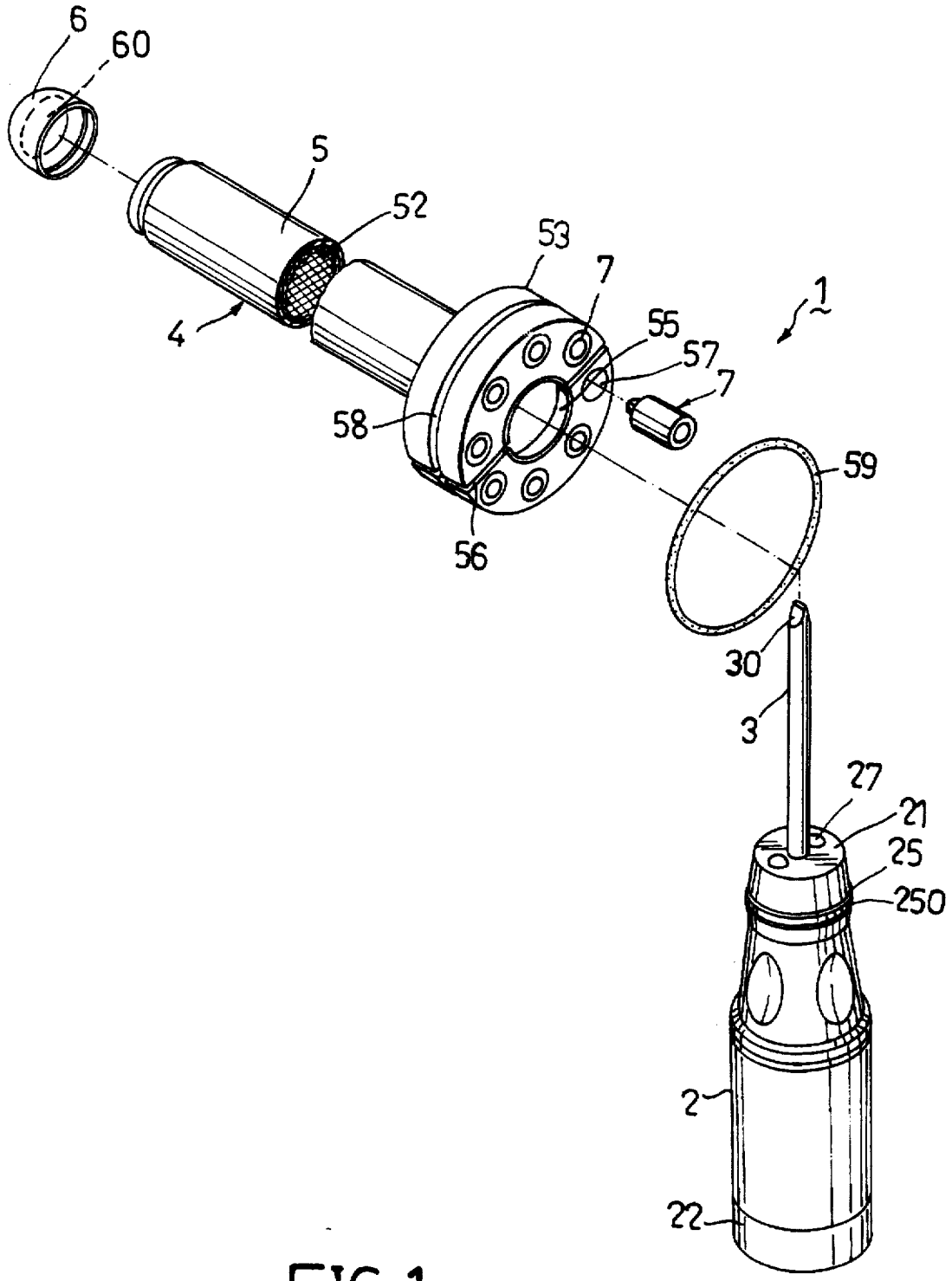
FIG. 1 is an exploded perspective view illustrating a screw driver according to a first preferred embodiment of the present invention.
Figure 2:
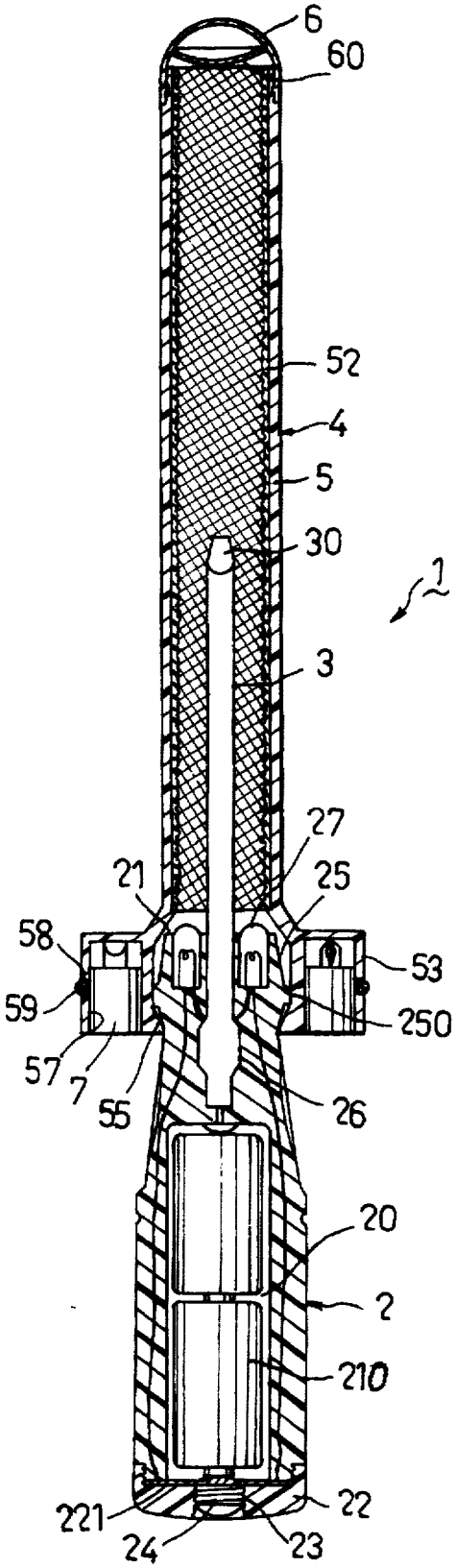
FIG. 2 is a cross-sectional view of the screw driver of FIG. 1.

Referring to FIGS. 1 and 2, the screw driver 1 according to the first preferred embodiment of the present invention is shown to include a handle body 2, a shank 3 and a light transmittable tubular member 4.

The handle body 2 has a front end portion 25 with an end surface 21. An illuminating unit 27, which includes a pair of lamps, is provided on the front end portion 25 at the end surface 21. The handle body 2 confines a compartment 20 for receiving a cell unit 210 therein. The handle body 2 has a rear end provided with a cover 22 which is mounted threadedly thereon. The cover 22 has an inner surface provided with a conducting piece 221 and is formed with a central screw hole 23. The handle body 2 is further provided with a switch unit 24 which extends through the screw hole 23. By threading the switch unit 24 inwardly, the conducting piece 221 is capable of connecting electrically the cell unit 210 to the illuminating unit 27, thereby activating the illuminating unit 27.

The front end portion 25 of the handle body 2 has a annular lip projection 250. The end surface 21 of the front end portion 25 is formed with a mounting hole 26 between the lamps for receiving the shank 3.

The shank 3 has a front end portion with a tip 30 and a rear end portion secured in the mounting hole 26 of the handle body 2 in such a manner that the shank 3 extends from the end surface 21 of the front end portion 25 of the handle body 2.

The light transmittable tubular member 4 is preferably made of acrylic material, and includes a tubular body 5 and an end piece 6 mounted on a front end of the tubular body 5. The tubular body 5 of the tubular member 4 has a rear end formed with a radial flange unit 53. The radial flange unit 53 is circular in shape and has a central opening with a gradually converging rear section 55. The radial flange unit 53 is further formed with a pair of diametrically opposite radial slits 56 to impart flexibility to the radial flange unit 53. The rear section 55 of the radial flange unit 53 engages the annular lip projection 250 of the front end portion 25 of the handle body 2 to mount detachably the tubular member 4 on the front end portion 25 of the handle body 2. The tubular member 4 is capable of transmitting light generated from the illuminating unit 27 to an exterior of the tubular member 4 so as to achieve a signaling effect. The end piece 6 of the tubular member 4 has an inner surface provided with a reflector 60. The tubular body 5 of the tubular member 4 has an inner surface provided with a plurality of light dispersing projections 52 which help transmit light generated from the illuminating unit 27 and reflected from the reflector 60 to the exterior of the tubular member 4 throughout the length of the tubular member 4 so as to enhance the signaling effect. The radial flange unit 53 is provided with a plurality of circumferentially arranged tool receiving spaces 57 that have axes parallel to the shank 3. The screw driver 1 further includes a plurality of tool bits 7, each of which is received removably in a respective one of the tool receiving spaces 57 and is mountable detachably on the tip 30 of the shank 3. The radial flange unit 53 has an outer surface formed with a peripheral retaining groove 58 that is communicated with the tool receiving spaces 57. The screw driver 1 further includes a resilient ring 59 which is received in the peripheral retaining groove 58 for retaining removably the tool bits 7 in the tool receiving spaces 57.

Figure 3:
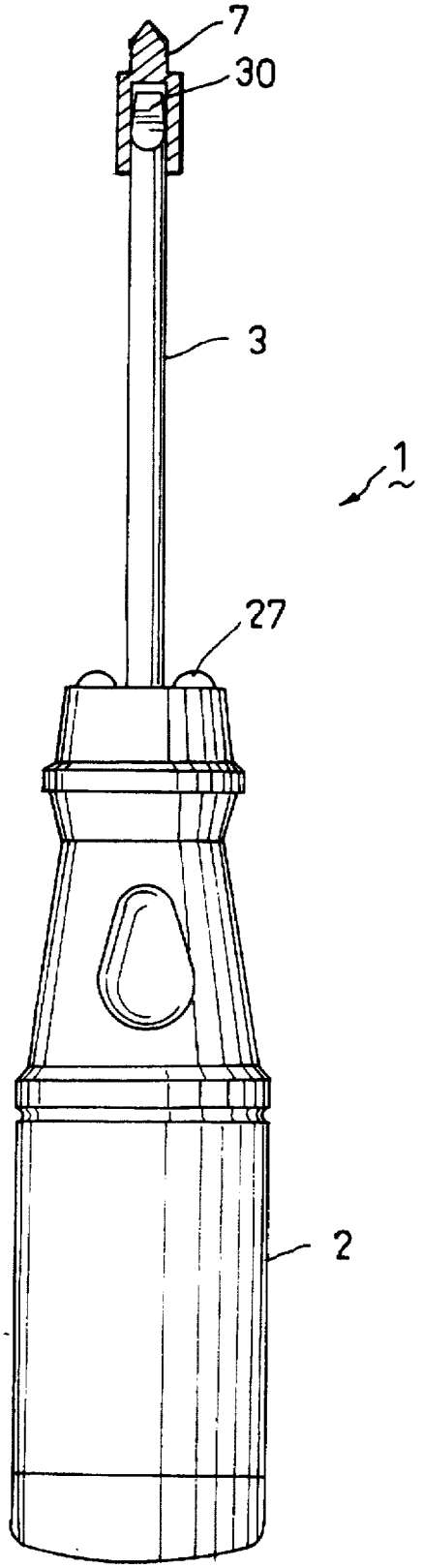
FIG. 3 illustrates the screw driver of FIG. 1 when used for driving a screw.

Referring to FIGS. 1 and 3, when the screw driver 1 is used for driving a screw, a suitable tool bit 7 is removed from the respective receiving space 57 and is mounted on the tip 30 of the shank 3. During an insufficient surrounding light condition, the switch unit 24 (see FIG. 2) is threaded inwardly to actuate the illuminating unit 27.

Figure 4:
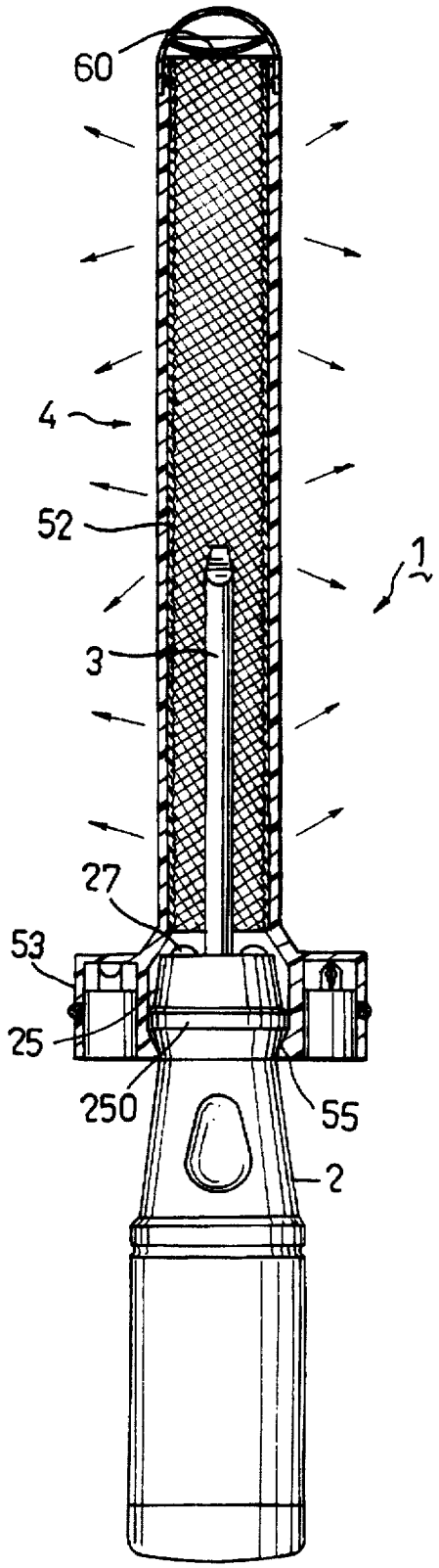
FIG. 4 illustrates the screw driver of FIG. 1 when used as a signaling device.

Referring to FIG. 4, when the screw driver 1 is used as a signaling device, such as a signaling stick, the light transmittable tubular member 4 is sleeved on the handle body 2 so that the rear section 55 of the radial flange unit 53 engages the annular lip projection 250 of the front end portion 25 of the handle body 2. The illuminating unit 27 is thus enveloped within the light transmittable tubular member 4. The switch unit 24 (see FIG. 2) is then threaded inwardly to actuate the illuminating unit 27. The light dispersing projections 52 and the reflector 60 provided in the light transmittable tubular member 4 cooperatively help to transmit light throughout the length of the tubular member 4 to the exterior of the tubular member 4.

Colors or dyes may be added into the acrylic material for enhancing brightness of the light transmittable tubular member 4.

Figure 5:
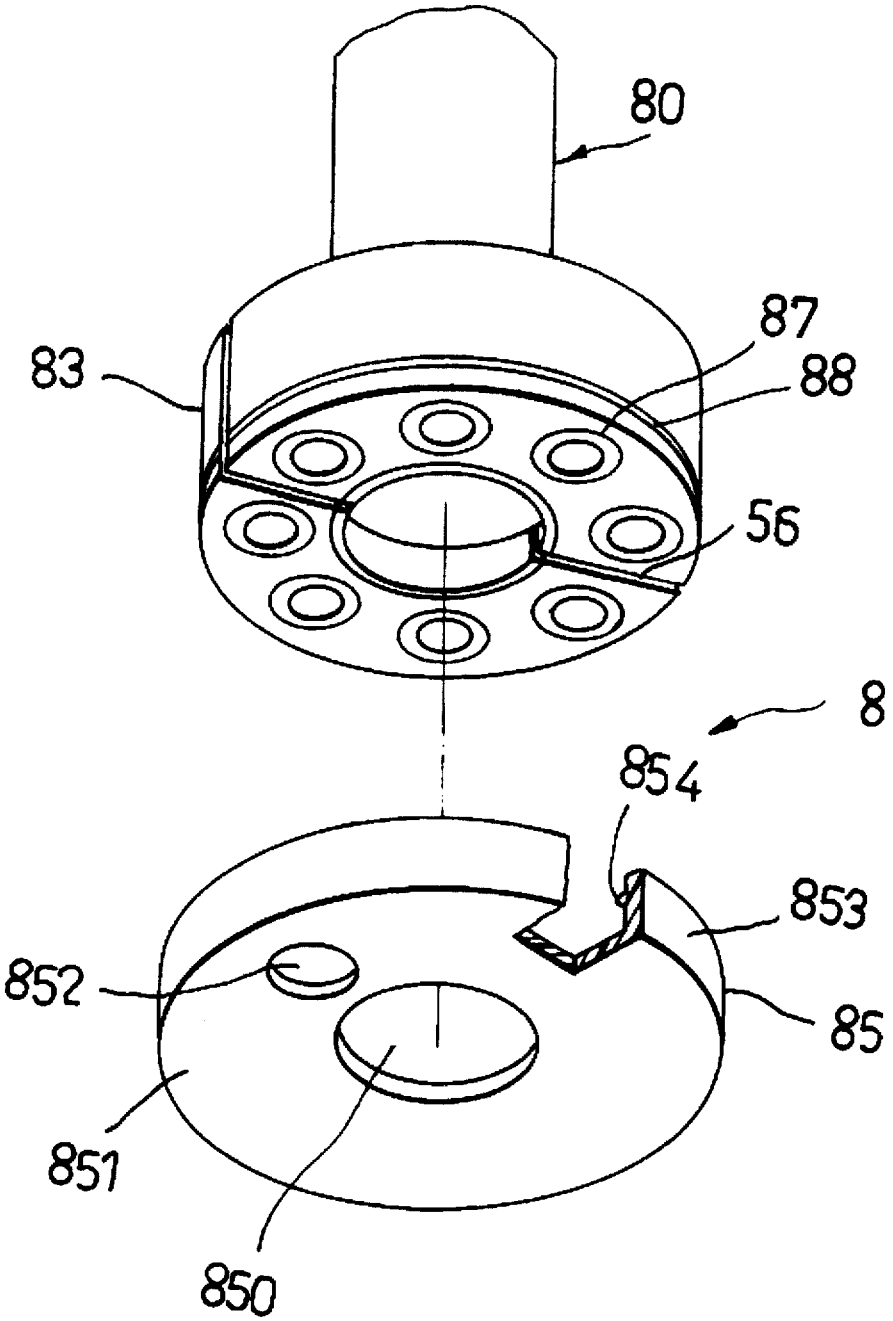
FIG. 5 is a partly enlarged, exploded perspective view illustrating a light transmittable tubular member and a circular cap of a screw driver according to a second preferred embodiment of the present invention.
Figure 6:
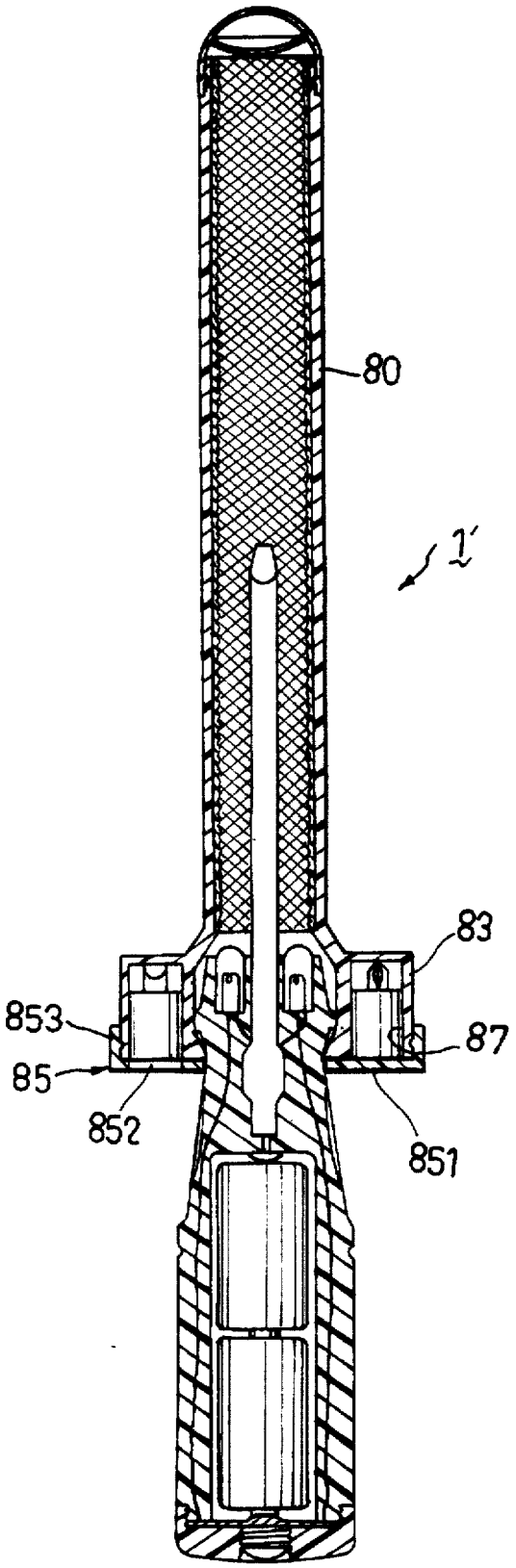
FIG. 6 is a cross-sectional view of the second preferred embodiment.

As shown in FIGS. 5 and 6, the screw driver according to a second preferred embodiment of the present invention includes a handle body, a shank, a light transmittable tubular member 80, and a plurality of tool bits. The handle body and the shank are similar to those of the first preferred embodiment. The light transmittable tubular member 80 has a rear end formed with a radial flange unit 83. The radial flange unit 83 is circular in shape and has an outer surface formed with an annular peripheral engaging groove 88. The radial flange unit 83 is provided with a plurality of circumferentially arranged tool receiving spaces 87, each of which has a rear open end and an axis parallel to the shank. The screw driver 1' further includes a circular cap 85 for covering the open ends of the tool receiving spaces 87. The circular cap 85 includes a circular plate 851 and a rim portion 853 extending transversely from an edge portion of the circular plate 851. The rim portion 853 has an inner surface formed with a radial protrusion 854 for engaging the engaging groove 88 to mount the circular cap 85 rotatably on the radial flange unit 83. The circular plate 851 is formed with an opening 850 to permit passage of the shank, and an aperture 852 to be aligned selectively with the open ends of the receiving spaces 87 so as to permit removal of a selected one of the tool bits from the radial flange unit 83. The operation of the screw driver 1' is similar to that of the first preferred embodiment and will not be detailed further.

The screw driver according to the present invention is capable of providing various types of tool bits for use in different conditions. Further, the screw driver is provided with an illuminating unit that is helpful when performing repair operations in the dark. By incorporating the light transmittable tubular member, the screw driver can also be used as a signaling device, such as a signaling stick. The multi-purpose screw driver according to the present invention is thus superior to the conventional ones.

With this invention thus explained, it is apparent that numerous modifications and variations can be made without departing from the scope and spirit of this invention. It is therefore intended that this invention be limited only as indicated in the appended claims.

I claim:

1. A screw driver comprising:

a handle body having a front end portion with an end surface, and an illuminating unit mounted on said front end portion at said end surface, said handle body confining a compartment for receiving a cell unit therein, said handle body being provided with a switch unit that is adapted to connect electrically said cell unit to said illuminating unit;

a shank mounted on said handle body and extending from said end surface of said front end portion of said handle body; and a light transmittable tubular member having a rear end mounted detachably on said front end portion of said handle body around said end surface of said front end portion, said tubular member being capable of transmitting light generated from said illuminating unit to an exterior of said tubular member so as to achieve a signaling effect.

2. The screw driver according to claim 1, wherein said rear end of said tubular member is formed with a radial flange unit which is provided with a plurality of tool receiving spaces, said screw driver further comprising a plurality of tool bits, each of said tool bits being received removably in a respective one of said receiving spaces and being mountable detachably on a tip of said shank.

3. The screw driver according to claim 2, wherein said receiving spaces are circumferentially arranged and have axes parallel to said shank.

4. The screw driver according to claim 3, wherein said radial flange unit is formed with a peripheral retaining groove, said screw driver further comprising a resilient ring that is received in said peripheral retaining groove for retaining removably said tool bits in said receiving spaces.

5. The screw driver according to claim 3, wherein said radial flange unit is circular in shape and is formed with an annular peripheral engaging groove, each of said receiving spaces having a rear open end, said screw driver further comprising a circular cap for covering said open ends of said receiving spaces, said circular cap including a circular plate and a rim portion extending transversely from an edge portion of said circular plate, said rim portion having an inner surface formed with a radial protrusion for engaging said engaging groove to mount rotatably said circular cap on said radial flange unit, said circular plate being formed with an opening to permit passage of said shank and an aperture to be aligned selectively with said open ends of said receiving spaces so as to permit removal of a selected one of said tool bits from said radial flange unit.

6. The screw driver according to claim 1, wherein said tubular member has a front end provided with a reflector and an inner surface provided with a plurality of light dispersing projections for transmitting light generated from said illuminating unit to the exterior of said tubular member throughout length of said tubular member.

* * * * *